US006488724B1

(12) United States Patent
Hertel et al.

(10) Patent No.: US 6,488,724 B1
(45) **Date of Patent: *Dec. 3, 2002**

(54) HEAVY OILS HAVING IMPROVED PROPERTIES AND AN ADDITIVE THEREFOR

(75) Inventors: Günther Hertel, Burgkirchen (DE); Michael Feustel, Köngernheim (DE); Hakan Byström, Karlstad (SE); Geoffrey Richards, Älvängen (SE)

(73) Assignee: Clariant GmbH, Frankfurt (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 105 days.

(21) Appl. No.: 08/957,834

(22) Filed: Oct. 27, 1997

(30) Foreign Application Priority Data

Oct. 30, 1996 (DE) ..... 196 43 832

(51) Int. Cl.[7] ..... C10L 1/18; C10L 1/22; C10L 1/24; C10L 1/26

(52) U.S. Cl. ..... 44/358; 44/363; 44/364; 44/366; 44/369; 44/433; 44/434

(58) Field of Search ..... 44/363, 364, 365, 44/433, 434, 366, 369; 208/47, 48 AA

(56) References Cited

U.S. PATENT DOCUMENTS

| | | | | | |
|---|---|---|---|---|---|
| 4,129,508 | A | | 12/1978 | Friihauf | 252/33 |
| 4,129,589 | A | | 12/1978 | Eliades et al. | 260/504 |
| 4,182,613 | A | * | 1/1980 | Stover et al. | |
| 4,347,062 | A | * | 8/1982 | Born et al. | 44/365 |
| 4,479,805 | A | * | 10/1984 | Batra | 44/301 |
| 4,505,718 | A | | 3/1985 | Dorer, Jr. | 44/66 |
| 4,604,188 | A | * | 8/1986 | Yan et al. | 208/106 |
| 4,622,047 | A | * | 11/1986 | Bernasconi et al. | |
| 4,659,338 | A | * | 4/1987 | Johnston et al. | |
| 4,690,687 | A | * | 9/1987 | Johnston et al. | |
| 4,804,389 | A | * | 2/1989 | Johnston et al. | |
| 4,885,110 | A | * | 12/1989 | Böse et al. | 252/341 |
| 5,039,450 | A | * | 8/1991 | Kupfer et al. | 252/331 |
| 5,421,993 | A | | 6/1995 | Hille et al. | 208/47 |

FOREIGN PATENT DOCUMENTS

| | | |
|---|---|---|
| EP | 0423744 A1 | 4/1991 |
| EP | 0476196 A1 | 3/1992 |
| FR | 2476645 | 8/1981 |
| FR | 2632966 | 12/1989 |

OTHER PUBLICATIONS

European Search Report.
Derwent Patent Family Report.

* cited by examiner

*Primary Examiner*—Margaret Medley
(74) *Attorney, Agent, or Firm*—Susan S. Jackson; Scott E. Hanf

(57) ABSTRACT

The additive described essentially comprises a selected alkoxylated fatty amine or fatty amine derivative and a special metal salt compound, preferably a metal soap. This additive for heavy oils effects a good emulsification or dispersion of asphaltenes and other higher-molecular weight compounds and, in addition, inter alia, increased storage stability, improved pumpability due to decreased viscosity of the oil and longer service lives of the filter systems. In addition, it also effects enhanced combustion of the heavy oils. The effective amount of additive in these oils is 2 to 2000 ppm. The oils described are suitable, in particular, as furnace fuel for industrial plants and power stations and as engine fuel for marine engines.

10 Claims, No Drawings

HEAVY OILS HAVING IMPROVED PROPERTIES AND AN ADDITIVE THEREFOR

The invention relates to an additive for improving the properties of heavy oils and to heavy oils containing this additive.

Heavy oils are obtained in the processing of petroleum types (crude oils) and are residues of processing operations such as distillation and atmospheric pressure or reduced pressure, thermal or catalytic cracking and the like. From the chemical viewpoint, these residual furnace fuels or residual engine fuels (bunker C oils) essentially comprise paraffinic, naphthenic and aromatic hydrocarbons, some of high molecular weight. The high molecular weight components, also termed asphaltenes, are not present in dissolved form, but in a more or less dispersed form, which gives rise to numerous problems. Thus, asphaltenes and likewise other poorly soluble or insoluble compounds (for example oxygen compounds, nitrogen compounds and sulfur compounds) and products of ageing, in the absence of effective dispersants, separate out from the oil phase, forming an extremely undesirable two-phase system. In the presence of water, or even only moisture, in addition, sludge formation can occur. All these higher-molecular weight compounds and contents in the heavy oil, in addition, adversely affect the oil combustion process, for example owing to intensified soot formation.

Heavy oils, in particular in the form of heavy fuel oils (Marine Fuel Oils) and of mixtures of heavy fuel oils and heavy distillates (Inter Fuel Oils) are used in large amounts, primarily as furnace fuel in industrial plants and power stations and as engine fuel for relatively slow-burning internal combustion engines, in particular marine engines. In the prior art, therefore, numerous proposals have already been made for additives which are intended to exclude the disadvantageous properties described of the heavy furnace fuel oils and engine fuel oils, that is, in particular, the formation of two phases by asphaltenes and other higher-molecular weight fractions, sludge formation and the impairment of combustion.

Thus, FR-A-2 172 797 describes basic iron salts of organic acids and FR-A-2 632 966 describes a mixture of iron hydroxide and a basic calcium soap as auxiliaries to enhance the combustion of heavy oils. U.S. Pat. No. 4,129,589 recommends highly basic and oil-soluble magnesium salts of sulfonic acids as oil additives. The more recent publication EP-A-476 196 describes, as oil additive, a mixture essentially comprising (1) at least one oil-soluble carbonyl manganese compound, (2) at least one oil-soluble neutral or basic alkali metal salt or alkaline earth metal salt of an organic acid component and (3) at least one oil-soluble dispersant selected from the group consisting of the succinimides. In addition, mention may also be made of U.S. Pat. No. 5,421,993, which describes alkoxylated fatty amines and fatty amine derivatives as corrosion inhibitors, demulsifiers and pour point depressants for crude oils.

It has now been found that the combination of alkoxylated fatty amine compounds and organic metal salts is a particularly effective additive for heavy oils, in particular with regard to emulsifying and/or dispersing asphaltenes, sludge and the like and also with regard to improving oil combustion.

The additive according to the invention essentially comprises a) 1 to 99% by weight, preferably 20 to 80% by weight, and in particular 40 to 60% by weight, of at least one amine compound of the formula (I) below (I)

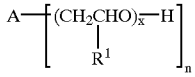

in which n is 1, 2, 3 or 4,

A is a radical of the formulae (II) to (V)

(II)

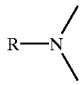

n = 2

(III)

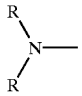

n = 1

(IV)

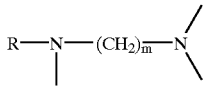

n = 3

(V)

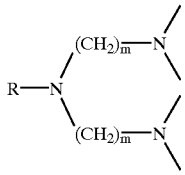

n = 4 where R is a $C_6$ to $C_{22}$ alkyl, preferably a $C_6$ to $C_{18}$ alkyl, and m is 2, 3 or 4, preferably 2 or 3, x is a number from 5 to 120, preferably 10 to 80, $R^1$ is H, $CH_3$ or H and $CH_3$, where the oxyalkylene radicals are arranged randomly or in blocks, and b) 1 to 99% by weight, preferably 20 to 80% by weight, and in particular 40 to 60% by weight, of at least one oil-soluble or oil-dispersible neutral or basic metal salt compound containing a metal of the first main group of the Periodic Table of the Elements, of the second main group, of the first subgroup, of the second subgroup, of the fourth subgroup, of the sixth subgroup, of the eighth subgroup or of the lanthanide group (rare earth metals) of the Periodic Table of the Elements and a carboxylic acid, sulfonic acid, acid ester of phosphoric acid or acid ester of sulfuric acid containing a hydrocarbon radical of in each case 8 to 40 carbon atoms, preferably 12 to 30 carbon atoms, as acid component, percentages by weight based on the additive.

Component a) of the additives according to the invention is an amine compound in accordance with formula (I). These alkoxylated fatty amines and fatty amine derivatives are prepared by conventional alkoxylation methods, by reacting an amine in accordance with radical A in formula (I) with x mol of ethylene oxide alone ($R^1$ is H and the polyoxyalkylene radical comprises ethylene oxide units) or with x mol of propylene oxide alone ($R^1$ is $CH_3$ and the polyoxyalkylene radical comprises propylene oxide units) or with x mol of ethylene oxide and propylene oxide simultaneously or in succession ($R^1$ is H and $CH_3$ and the polyoxyalkylene radical comprises ethylene oxide and propylene oxide units which are present in a random distribution or in blocks). The reaction is generally carried out at a temperature of 100 to 180° C. in the presence or absence of an alkali or acid alkoxylation catalyst in the absence of air. Preferred amine compounds as component a) correspond to the formula (VI) below

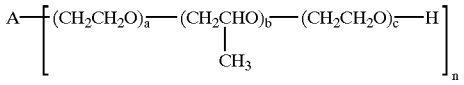

(VI)

in which

| | |
|---|---|
| n | is 1, 2, 3 or 4, |
| A | is a radical of the above specified formulae (II) to (V), |
| a | is a number from 5 to 30, preferably 8 to 20, |
| b | is a number from 5 to 50, preferably 10 to 30, and |
| c | is a number from 0 to 40, preferably 0 to 20. |

The amine compounds of the formula (VI) and their preparation are described extensively in U.S. Pat. No. 5,421,993 mentioned at the outset, which is herein incorporated by reference. They are obtained by alkoxylation of amines of the specified formula (II) to (V), initially with ethylene oxide, and then with propylene oxide, with addition of bases such as alkali metal hydroxides. The reaction is performed in stages at a temperature of preferably 100 to 160° C. The amount of catalyst/base used is generally 0.5 to 3.0% by weight, based on the starting amine used. The molar amount of ethylene oxide and propylene oxide per mol of starting amine corresponds to the specified values of a and b and the values of c. In detail, reference is made to said U.S. Pat. No. 5,421,993. The following summary gives examples of suitable amine compounds ($a_1$ to $a_6$) according to Formula (I) as component a):

TABLE 1

| | Formula (I) | | | | |
|---|---|---|---|---|---|
| Compound | A | R | a | b | c |
| $a_1$ | II | $C_{14}$ to $C_{18}$ alkyl unsaturated | 22 | 33 | 0 |
| $a_2$ | III | $C_{14}$ to $C_{18}$ alkyl unsaturated | 6 | 9 | 0 |
| $a_3$ | V | $C_{14}$ to $C_{18}$ alkyl unsaturated | 22 | 33 | 0 |
| $a_4$ | IV | $C_{14}$ to $C_{18}$ alkyl unsaturated | 22 | 33 | 0 |
| $a_5$ | III | $C_{14}$ to $C_{18}$ alkyl unsaturated | 12 | 28 | 25 |
| $a_6$ | III | $C_{14}$ to $C_{18}$ alkyl unsaturated | 12 | 28 | 15 |

Preferred metals in the metal salt compound of the component b) are the alkali metals or alkaline earth metals (first and second main group of the Periodic Table of the Elements), copper or silver (first subgroup), zinc or cadmium (second subgroup), titanium or zirconium (fourth subgroup), molybdenum, chromium or tungsten (sixth subgroup), iron, cobalt or nickel (eighth subgroup) and lanthan, cerium or ytterbium (lanthanide group). Particularly preferred metals are the alkaline earth metals, such as barium, beryllium, calcium or magnesium, copper, zinc, zirconium, molybdenum, iron, nickel, cerium or ytterbium.

Preferred acids in the metal salt compound of the component b) are aliphatic carboxylic acids having 8 to 40 carbon atoms, preferably 12 to 30 carbon atoms. The aliphatic radical can be unbranched or branched, saturated or unsaturated. The aliphatic carboxylic acids are preferably fatty acids having 8 to 40 carbon atoms, preferably 12 to 30 carbon atoms. The aliphatic carboxylic acids and fatty acids can be of synthetic or natural type, and they can be present as such or as a mixture of two or more acids. Examples which may be mentioned are octanoic acid (caprylic acid), decanoic acid (capric acid), dodecanoic acid (lauric acid), tetradecanoic acid (myristic acid), hexadecanoic acid (palmitic acid), octadecanoic acid (stearic acid), eicosanoic acid (arachic acid), docosanoic acid (behenic acid), dodecenoic acid (lauroleic acid), tetradecenoic acid (myristoleic acid), hexadecenoic acid (palmitoleic acid), octadecenoic acid (oleic acid), 12-hydroxyoctadecenoic acid (ricinoleic acid), octadecadienoic acid (linoleic acid) and octadecatrienoic acid (linolenic acid), as well as coconut fatty acid, tallow fatty acid, palm kernel fatty acid and the like.

In addition to said (simple) fatty acids, dimeric fatty acids are also preferred acid components. These dimeric fatty acids correspond to the formula (VII)

$$HOOC—R^2—COOH \quad (VII)$$

in which $R^2$ is a divalent hydrocarbon radical having 34 carbon atoms ($R^2$ is therefore the radical which contains 34 carbon atoms and is formed in the dimerization of an unsaturated fatty acid containing 18 carbon atoms to give a dicarboxylic acid having a total of 36 carbon atoms).

As is known, they are prepared by dimerizing unsaturated $C_{18}$ fatty acids, for example oleic acid, linoleic acid, linolenic acid or tallow fatty acid (dimerization is taken to mean combining two identical molecules to form one new molecule, the dimer, by addition reaction). $C_{18}$ fatty acids are generally dimerized at a temperature of 150 to 250° C., preferably 180 to 230° C., with or without a dimerization catalyst. The resulting dicarboxylic acid (that is the dimeric fatty acid) corresponds to the formula VII given, where $R^2$ is the divalent connection member which is formed in the dimerization of the $C_{18}$ fatty acid, bears the two —COOH groups and has 34 carbon atoms. $R^2$ is preferably an acyclic (aliphatic) or a monocyclic or bicyclic (cycloaliphatic) radical having 34 carbon atoms. The acyclic radical is generally a branched (substituted) and monounsaturated to triunsaturated alkyl radical having 34 carbon atoms. The cycloaliphatic radical generally likewise has 1 to 3 double bonds. The preferred dimeric fatty acids described are generally a mixture of two or more dicarboxylic acids of the formula VII having structurally different $R^2$ radicals. The dicarboxylic acid mixture frequently has a greater or lesser content of trimeric fatty acids, which were formed in the dimerization and were not removed in the product work-up by distillation. Similar mixtures are obtained from natural products, for example in the production of colophony from pine extract. Below, some dimeric fatty acids may be specified as formulae, in which the hydrocarbon radical bearing the two —COOH groups is an acyclic, monocyclic or bicyclic radical:

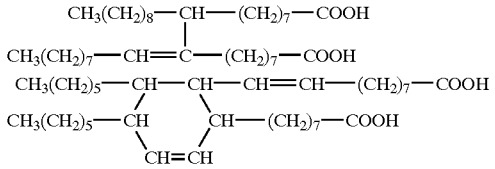

-continued

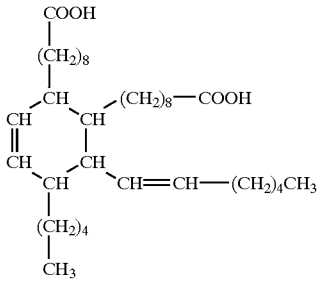

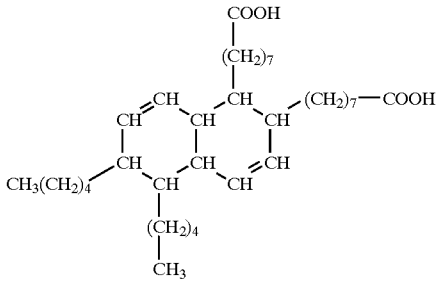

The dimeric fatty acids described are commercially available under the name "dimerized fatty acids", or "dimeric fatty acids" and, as already mentioned above, can have a greater or lesser content of trimerized fatty acids.

Preferred acids in the metal salt compound of the component b) are, furthermore, aliphatic or aromatic sulfonic acids having 8 to 40 carbon atoms, preferably 12 to 30 carbon atoms, in the aliphatic or aromatic radical. Here also, the aliphatic radical can be unbranched or branched, saturated or unsaturated. The aromatic sulfonic acid is preferably a benzene sulfonic acid having an alkyl or alkenyl radical containing 12 to 30 carbon atoms. Among said representatives, the metal soaps are particularly preferred as component b).

The organic metal salt to be used according to the invention as component b) can be prepared by the methods described in the prior art. Reference may be made in this case in particular to the publications mentioned at the outset FR-A-2 172 797, FR-A-2 632 966, U.S. Pat. No. 4,129,589 and EP-A-476 196, which are incorporated herein. The organic metal salts to be used according to the invention shall be oil-soluble or at least oil-dispersible. In addition, these relate to a neutral or basic product, the latter being preferred. The expression "basic", as is known, describes metal salts in which the metal is present in a higher stoichiometric amount than the organic acid radical. The basic metal salt products to be used according to the invention therefore have a pH of generally 7.5 to 12, preferably from 8 to 10.

The additive according to the invention is prepared by mixing together the components a) and b), with or without the use of a solvent or dispersion medium. Suitable solvents or dispersion media of this type are lower or higher alcohols such as ethanol, isopropanol, butanol, decanol, dodecanol and the like, lower or higher glycols and their monoalkyl or dialkyl ethers such as ethylene glycol, propylene glycol, diethylene glycol, tetra-ethylene glycol, tetrapropylene glycol and the like, low-to medium-boiling aliphatic, aromatic or cycloaliphatic hydrocarbons such as toluene, xylene, naphtha and the like, light to medium-heavy mineral oils, oil distillates, natural or synthetic ails and derivatives thereof and mixtures of two or more of these solvents. The two components, amine compound and metal salt compound, are generally brought together at atmospheric pressure and at a temperature of 15 to 100° C., preferably 20 to 70° C.

The heavy oils according to the invention feature a content of the additive described. The active amount of additive in the heavy oil can vary. within broad limits. Generally, the oil contains 2 to 2000 ppm of additive, preferably 100 to 1000 ppm.

The additive according to the invention and the heavy oils containing this additive have a property profile which is particularly desired, and this could be primarily due to an unexpectedly high synergy of the combination according to the invention of the components a) and b). Thus the additive is present in the oil in dissolved or highly dispersed form. Even in oils having a high content of asphaltenes and/or other higher-molecular weight compounds, all these insoluble fractions are highly emulsified or dispersed. The same also applies in the case of sludges, so that sludge formation is also largely excluded or at least markedly decreased. The additive according to the invention, moreover, is a highly effective combustion enhancer. It ensures the complete combustion of heavy oils with simultaneous decrease in soot formation. The heavy oils according to the invention therefore comply to a surprisingly great degree with the requirements mentioned at the outset. As a result of said actions, the additive according to the invention leads to oils which, furthermore, also have in particular the following advantageous properties: improved storage stability (reduced sedimentation of insoluble cons tituents), improved pumpability owing to low viscosity, longer operating life of the filter system, improved injection behavior at the combustion devices, which additionally contribute to optimizing the combustion, and increased corrosion protection for all devices owing to the high inhibition of corrosion by the additive. The heavy oils according to the invention are therefore primarily used as furnace fuel for industrial plants and power stations and likewise as engine fuel for marine engines.

The invention is now described in more detail by means of examples and comparison examples.

Component a) of the additive according to the invention:

As component a), use is made of the compounds $a_1$, $a_3$ and $a_5$ of Table 1.

Component b) of the additive according to the invention:

As component b), use is made of the products $b_1$ and $b_2$ described in more detail below.

Product $b_1$:

The fatty acid used to prepare product $b_1$ is a distilled fatty acid consisting of a blend of distilled tall oil fatty acid and resin acid having a molecular weight of about 300 g/mol.

| Batch: | | |
|---|---|---|
| $FeCl_3$ | 0.85 l | density 1.48 g/cm$^3$ |
| $NH_3$ | 0.785 l | density 0.91 g/cm$^3$ |
| Fatty acid | 0.22 l | density 0.94 g/cm$^3$ |
| Water | 0.20 l | |
| Petroleum distillate | 0.80 l | density 0.82 g/cm$^3$ |

The 0.85 l of $FeCl_3$, 0.22 l of fatty acid, 0.20 l of water and 0.80 l of petroleum distillate are mixed with one another at room temperature (15 to 30° C.).

The 0.785 l of $NH_3$ are introduced slowly (exothermic reaction) into this mixture with stirring. The mixture is heated with stirring to 80 to 90° C., giving an aqueous phase and an organic phase. The phase formation can be completed by adding further petroleum distillate. The two phases are separated from one another (decanted), whereupon the organic phase is further centrifuged to separate off residual water. The organic phase contains the desired iron carboxylate compound.

Product $b_2$:

The fatty acid used to prepare product $b_2$ is an alkylbenzenesulfonic acid having a molecular weight of about 322 g/mol.

| Batch: | | |
|---|---|---|
| $FeCl_3$ | 44 ml | density 1.48 g/cm$^3$ |
| $NH_3$ | 34 ml | density 0.91 g/cm$^3$ |
| Acid | 13 ml | density 1.06 g/cm$^3$ |
| Water | 16 ml | |
| Petroleum distillate | 84 ml | density 0.82 g/cm$^3$ |

Product $b_2$, an iron alkylbenzenesulfonate, is prepared in a similar manner to product $b_1$.

Additives According to the Invention

EXAMPLE 1 a) 40% by weight of compound $a_1$ b) 60% by weight of the organic iron salt according to product $b_1$

EXAMPLE 2 a) 60% by weight of compound $a_3$ b) 40% by weight of the organic iron salt according to product $b_2$

EXAMPLE 3 a) 50% by weight of compound $a_5$ b) 50% by weight of the organic iron salt according to product $b_1$ The additives according to the invention of the Examples 1 to 3 are prepared by mixing together the components a) and b) (mixing temperature about 20 to about 60° C.). According to a preferred procedure, the component a) is introduced first and is heated to about 40 to 50° C. with stirring and under a nitrogen atmosphere. The component b) is then stirred in at said temperature under a nitrogen atmosphere, whereupon the additive according to the invention is prepared. If the mixture cooled to room temperature does not have the desired viscosity and/or phase separation is observed, these phenomena may be eliminated by adding an effective amount of an organic solvent such as petroleum distillate.

Test of the additives according to the invention:

The additives of Examples 1 to 3 are tested with respect to asphaltene dispersibility and enhancement of combustibility of heavy oils. For the test of asphaltene dispersibility, a solution containing asphaltenes is first prepared.

Preparation of a solution of asphaltenes in toluene:

To prepare this solution, a residual oil containing asphaltenes is subjected to an extraction which, in detail, is carried out as follows. In a first step, about 30 g of residual oil is admixed in a glass beaker with about 300 ml of ethyl acetate. The mixture is stirred for 2 hours at 40° C. and then allowed to stand for 24 hours, whereupon it is filtered through a simple pore filter. In a second step, the filter residue is placed into an extraction thimble customary for Soxhlet extraction and extracted for about 2 hours using again about 300 ml of ethyl acetate, the paraffin fraction in the filter cake passing into the ethyl acetate phase. In a third step, the resin fractions are likewise dissolved out by Soxhlet extraction using about 300 ml of pentane. In a fourth step, the asphaltenes are then extracted using about 300 ml of toluene, which produces the desired solution of asphaltenes in toluene.

Test of the additive according to the invention on asphaltene dispersibility:

This test is carried out in accordance with the standards ISO 10307-1:1993 or ASTM D4370-32 (hot filtration). For this, 30 g of a roughly 10% strength by weight asphaltene solution in toluene are first mixed with 100 ml of pentane. 700 ppm of additive from each of Examples 1, 2 and 3 are stirred separately into three of such asphaltene-toluene/pentane solutions at room temperature. These three test solutions are then treated in accordance with said standards. Result: the additives according to the invention comply with the test.

Test of the additives according to the invention for enhancement of the combustibility of heavy oils:

This test is carried out in accordance with the directions of VDI 2066, part 1 (VDI is Verein deutscher Ingenieure [German Engineers' Association]), the additives of Examples 1, 2 and 3 being used in an amount of 500 ppm, 700 ppm and 900 ppm. Result: the additives according to the invention comply with the test.

COMPARISON EXAMPLES 1 To 3

In the Comparison Examples 1 to 3, the compounds $a_1$, $a_3$ and $b_1$ are each used alone. The three test solutions are subjected to the same test methods as the examples according to the invention.

Result: none of the test solutions comply with the test of asphaltene dispersibility or that of enhancement of combustibility.

The additives according to the invention therefore possess an unexpectedly high efficacy with respect to dispersion of asphaltenes in heavy oils and also with respect to combustion of heavy oils; this could result from a surprisingly high synergy of the additive components a) and b). Owing to the advantageous actions of the novel additive, the oils according to the invention also especially have those properties which are particularly wanted for use in industrial plants, power stations and heavy marine engines.

What is claimed is:

1. A process for improving the dispersion of asphaltenes contained in heavy fuel oil, comprising incorporating in said asphaltene containing heavy fuel oil, from 2 to 2000 parts per million parts of said oil of a) and b) wherein a) is at least one amine compound of the formula (I) below

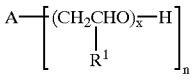

(I)

in which n is 1, 2, 3, or 4,

A is a radical selected from the group consisting of the formulae (II) to (V)

(II)

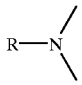

n = 2

(III)

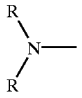

n = 1

(IV)

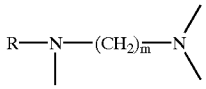

n = 3

(V)

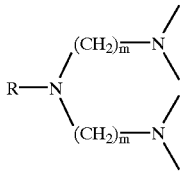

n = 4 where R is a $C_6$ to $C_{22}$ alkyl, and m is 2, 3, or 4,

X is a number from 5 to 120, $R_1$ is H, $CH_3$ or H and $CH_3$, where the oxyalkylene radicals are arranged randomly or in blocks, and b) is an oil-soluble or oil-dispersible neutral or basic metal salt compound containing a metal selected from the group consisting of an alkali metal, an alkaline earth metal, copper, silver, zinc, cadmium, titanium, zirconium, molybdenum, chromium, tungsten, iron, cobalt, nickel, lanthan, cerium, and ytterbium, and an organic acid component selected from the group consisting of a carboxylic acid, sulfonic acid, add ester of phosphoric acid, and acid ester of sulfuric acid, each said add and ester containing a hydrocarbon radical of 8 to 40 carbon atoms as the acid component and emulsifying and/or dispersing said asphaltenes in said heavy fuel oil.

2. The process of claim 1 wherein said fuel is a fuel for an industrial plant or power station.

3. The process of claim 1 wherein said fuel is a fuel for a marine engine.

4. The process of claim 1 wherein the component b) is a metal salt compound containing a metal selected from the group consisting of alkali metals, alkaline earth metals, copper, silver, zinc, cadmium, titanium, zirconium, molybdenum, chromium, tungsten, iron, cobalt, nickel, lanthan, cerium, and ytterbium, and containing an acid selected from the group consisting of aliphatic carboxylic acids having 8 to 40 carbon atoms, dimeric fatty acids having 36 carbon atoms and aliphatic and aromatic sulfonic acids having 8 to 40 carbon atoms.

5. The process of claim 1 wherein the component b) is a metal salt compound containing a metal selected from the group consisting of an alkaline earth metal, copper, zinc, zirconium, molybdenum, iron, nickel, cerium and ytterbium.

6. The process of claim 1, wherein said component a) is an amine compound of the formula (VI)

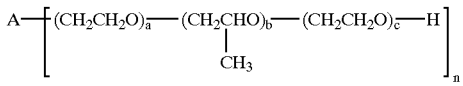

in which n is 1, 2, 3, or 4,

A is a radical of the formula selected from the group consisting of (II) to (V) in claim 1, a is a number from 5 to 30, b is a number from 5 to 50, and c is a number from 0 to 40.

7. The process of claim 1, wherein 1% to 99% by weight of a) and 1% to 99% by weight of b) are present in the total weight of a) and b).

8. The process of claim 1, wherein 20% to 80% by weight of a) and 20% to 80% by weight of b) are present in the total weight of a) and b).

9. The process of claim 8, wherein 40% to 60% by weight of a and 40 to 60% by weight of b) are present in the total weight of a) and b).

10. The process of claim 9, wherein 50% by weight of a) and 50% by weight of b) are present in the total weight of a) and b).

* * * * *

UNITED STATES PATENT AND TRADEMARK OFFICE

CERTIFICATE OF CORRECTION

PATENT NO. : 6,488,724 B1
DATED : December 3, 2002
INVENTOR(S) : Guenther Hertel et al.

It is certified that error appears in the above-identified patent and that said Letters Patent is hereby corrected as shown below:

Title page,
Item [73], Assignee, replace "Clariant GmbH, Frankfurt (DE)" with -- Clariant GmbH, Frankfurt (DE) and BYCOSIN AB, Karlstad, (SE) --.

Signed and Sealed this

First Day of July, 2003

JAMES E. ROGAN
*Director of the United States Patent and Trademark Office*